US008899251B2

(12) United States Patent
Leung et al.

(10) Patent No.: US 8,899,251 B2
(45) Date of Patent: Dec. 2, 2014

(54) POOL CANOPY SYSTEM

(75) Inventors: Chi Yin Alan Leung, Chai Wan (HK); Ricky Tong, Hong Kong (CN)

(73) Assignee: Polygroup Macau Limited (BVI), Tortola (VG)

( * ) Notice: Subject to any disclaimer, the term of this patent is extended or adjusted under 35 U.S.C. 154(b) by 21 days.

(21) Appl. No.: 13/311,226

(22) Filed: Dec. 5, 2011

(65) Prior Publication Data

US 2013/0092205 A1 Apr. 18, 2013

Related U.S. Application Data

(60) Provisional application No. 61/419,487, filed on Dec. 3, 2010.

(51) Int. Cl.

| | |
|---|---|
| ***E04H 15/02*** | (2006.01) |
| ***E04H 15/40*** | (2006.01) |
| ***E04H 4/10*** | (2006.01) |
| ***E04H 4/00*** | (2006.01) |

(52) U.S. Cl.

CPC ..... *E04H 4/108* (2013.01); *E04H 4/0025* (2013.01); *E04H 15/02* (2013.01); *E04H 15/40* (2013.01)

USPC ..... 135/96; 135/161; 135/125; 135/120.3; 4/494; 4/498

(58) Field of Classification Search

USPC ..... 135/96, 124–126, 128, 136, 143, 161; 4/498, 503, 494

See application file for complete search history.

(56) References Cited

U.S. PATENT DOCUMENTS

| | | | | |
|---|---|---|---|---|
| 4,136,408 | A | 1/1979 | Dahlbeck et al. | |
| 5,617,681 | A * | 4/1997 | Lyons | 52/82 |
| 6,179,367 | B1 * | 1/2001 | Bowen | 296/161 |
| 6,209,149 | B1 | 4/2001 | Song et al. | |
| 6,272,695 | B1 | 8/2001 | Brandner | |
| 6,725,871 | B1 * | 4/2004 | Shearer et al. | 135/88.01 |
| 7,516,577 | B1 | 4/2009 | Ranieri et al. | |
| 7,699,186 | B2 * | 4/2010 | Zheng | 220/565 |
| 7,708,339 | B2 * | 5/2010 | Zapater | 297/184.11 |
| 7,721,361 | B1 | 5/2010 | Shubert | |
| 2005/0028852 | A1 | 2/2005 | Reese | |
| 2011/0017250 | A1 * | 1/2011 | Shih | 135/90 |

FOREIGN PATENT DOCUMENTS

| | | |
|---|---|---|
| CN | 2937358 | 8/2007 |
| DE | 2434276 | 1/1976 |

OTHER PUBLICATIONS

British Search Report dated Apr. 5, 2012 for related British Patent Application No. 1120798.2.

* cited by examiner

*Primary Examiner* — David R Dunn
*Assistant Examiner* — Danielle Jackson
(74) *Attorney, Agent, or Firm* — Troutman Sanders LLP; Ryan A. Schneider; Daniel Sharpe

(57) ABSTRACT

A canopy system comprising a shading element, a support element, and an attachment element member. The canopy system is adapted to provide shade over at least a portion of an above-ground container. The canopy system is configured to maintain its structure during slightly windy and mild weather conditions.

14 Claims, 15 Drawing Sheets

POOL CANOPY SYSTEM

CROSS REFERENCE TO RELATED APPLICATION AND PRIORITY CLAIM

This application claims the benefit, under 35 U.S.C. §119 (e), of U.S. Provisional Patent Application No. 61/419,487, filed 3 Dec. 2010, entitled "Pool Canopy System," the entire contents and substance of which is incorporated herein by reference in its entirety as if fully set forth below.

TECHNICAL FIELD

The present disclosure is directed to a canopy system and, more particularly, to a canopy system adapted to provide shade for above-ground containers, such as pools, spas, and Jacuzzi tubs.

BACKGROUND

Embodiments of the present invention relate to a canopy system and, more particularly, to a canopy system adapted to provide shade for above-ground containers, such as pools, spas, and Jacuzzi tubs.

Most pool users utilize outdoor pools when the weather is warm, and more particularly during the summer months. Warm weather and summer months bring about intense sunlight bearing sun rays that can cause sunburn, sun blindness, discomfort, and in extreme cases may lead to skin cancer. Such intense sunlight can also interfere with the enjoyment of the swimming pool and corresponding swimming pool activities. Also, because the pool is outside, the pool is subject to other environmental conditions such as wind or rain.

SUMMARY

Briefly described, embodiments of the present invention relate to a canopy system. Embodiments of the canopy system are adapted to provide shade over at least a portion of above-ground containers, such as ring-type and/or frame above ground swimming pools. The canopy system can be referred to as a pool canopy system because it is used generally with a swimming pool, comprises a shading element, a support element, and an attachment element.

More specifically, the shading element comprises at least one piece of a shading material and is adapted to extend over an above-ground container to shade a portion of the container. The support element comprises a support member and a shade support and is adapted to maintain a shaped configuration, for example an arc-like shape, of the shading element. The attachment element can comprise a plurality of brackets, straps, or a combination of the foregoing, and is adapted to secure the shading element to the above-ground container.

In one embodiment, the present invention is a canopy system for shading at least a portion of an above-ground container. The canopy system can comprise a shading element and a support element. In various embodiments, the shading element can comprise a bottom portion and a top portion, wherein the shading element extends in a generally upward and outward direction from the bottom portion to the top portion. In still further embodiments, the support element can comprise at least one support member and at least one shade support. The bottom portion of the shading element can be configured to be positioned adjacent to the above-ground container. The top portion of the shading element can be configured to extend a vertical distance above a portion of the above-ground container. The top portion of the shading element is configured to extend a horizontal distance above a portion of the above-ground container in an arc-like fashion. In some embodiments, the shading element is substantially semi-circular in shape when laid flat.

The shading element of the present invention can comprise a plurality of shading materials that are attached together.

The support element can be adapted to provide structure and durability to the shading element.

In some embodiments, at least one support member extends from a first end of the shading element, along at least a portion of a front edge of the shading element, to a second end of the shading element.

In further embodiments, the first end of the at least one support member or the second end of the support member are affixed to the ground. In still further embodiments, the first end of the at least one support member or the second end of the at least one support member are affixed to the ground by inserting the first end of the at least one support member or the second end of the at least one support member into the ground. In additional embodiments, the first end of the at least one support member or the second end of the at least one support member are affixed to the ground by a support member securement device. In some embodiments, the support member securement device is a ground stake.

In additional embodiments, a portion of the first end of the at least one support member or a portion of the second end of the at least one support member are affixed to a portion of a frame of the above-ground container.

In further embodiments, the present invention can comprise at least one bracket to affix a first end of a support member or a second end of a support member to a portion of a frame of the above-ground container. In additional embodiments, the bracket can receive a vertical support of the frame of the above-ground container.

In additional embodiments, a shading element of the present invention can comprise a plurality of semi-rigid or rigid shade supports that extend in a generally vertical direction from approximately a bottom portion of the shading element to approximately a top portion of the shading.

In still further embodiments, a shading element of the present invention can comprise at least one secondary shading element support that extends from approximately a top portion of the shading element to approximately a bottom portion of the shading element. In additional embodiments, a shading element of the present invention can comprise a plurality of straps that attach the secondary shading element support to the ground via at least one support member securement.

In some embodiments, a shading element of the present invention can comprise a plurality of straps that attach a bottom portion of the shading to a first portion of a frame of the above-ground container and attach at least a portion of a front edge of the shading element to a second portion of the frame of the above-ground container.

Further features of embodiments of the present invention, and the advantages offered thereby, are explained in greater detail hereinafter with reference to specific embodiments illustrated in the accompanying drawings, wherein like elements are indicated by like reference designators.

DETAILED DESCRIPTION

Figure 1A:
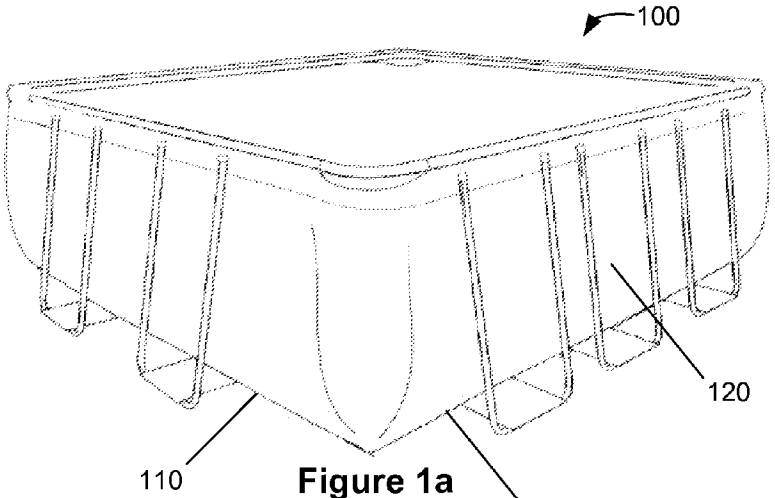
Figure 1a PRIOR ART
FIG. 1*a* is a perspective view of an above-ground container, specifically a rectangular frame swimming pool, in accordance with the prior art.
Figure 1B:
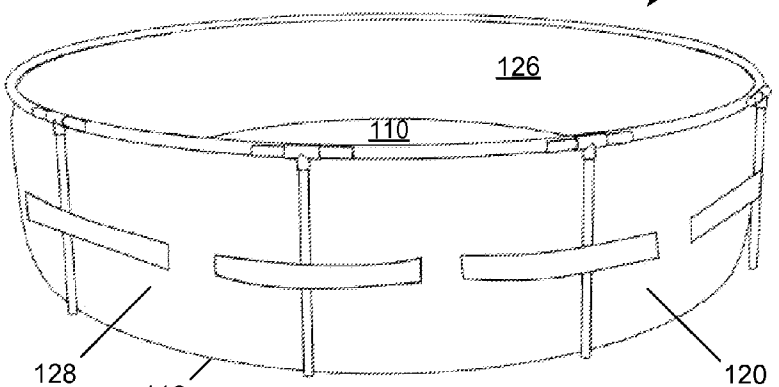
Figure 1b PRIOR ART
FIG. 1*b* is a perspective view of another above-ground container, specifically a round frame swimming pool, in accordance with the prior art.

To facilitate an understanding of the principles and features of embodiments of the invention, they are explained hereinafter with reference to their implementation in an illustrative embodiment.

Embodiments of the present invention can be understood more readily by reference to the following detailed description and the examples included herein. Before the embodiments of the devices and methods according to the present invention are disclosed and described, it is to be understood that this invention is not limited to the embodiments described within this disclosure. Numerous modifications and variations therein will be apparent to those skilled in the art remain within the scope of the invention. It is also to be understood that the terminology used herein is for the purpose of describing specific embodiments only, and is not intended to be limiting.

Unless otherwise noted, the terms used herein are to be understood according to conventional usage by those of ordinary skill in the relevant art. In addition to the definitions of terms provided below, it is to be understood that as used in the specification and in the claims, "a" or "an" can mean one or more, depending upon the context in which it is used.

As used herein, "pool" refers to and includes an above-ground or free-standing swimming pool, spa, water tank, or other above-ground liquid containment enclosure.

Additionally, the materials and components described hereinafter as making up the various elements of the canopy system are intended to be illustrative and not restrictive. Many suitable materials and components that would perform the same or a similar function as the materials and components described herein are intended to be embraced within the scope of the invention. Such other materials and components not described herein can include, but are not limited to, materials and/or components that are developed after the time of the development of embodiments of the present invention, for example.

Embodiments of the present invention are described in the context of being a canopy system, and more specifically a pool canopy system, adapted to shade at least a portion of above-ground swimming pools. The various embodiments of the pool canopy system shields pool users from direct exposure to sunlight, is durable, and is structurally compatible with both above-ground frame and ring pools.

Above-Ground Swimming Pools

Referring now to the drawings, wherein like reference numerals represent like parts throughout, the canopy system is securable and supported by a container, or portable swimming pool, constructed in accordance with the following description. Four different containers can be seen in the perspective views illustrated in FIGS. 1*a*-1*d*. As shown in FIGS. 1*a*-1*d*, an above-ground swimming pool 100 comprises a base 110 and a sidewall 120, which is made from a physical material and is formed in a particular shape.

The pool 100 can be a pop-up type of pool, which is collapsible in nature. A frame pool is typically pre-fabricated and includes a plurality of external vertical braces or frames for supporting the frame pool above the ground (see, FIGS. 1*a* and 1*b*). Frame pools can be made of metal, plastic, and the like. Pop-up, or ring-type, pools are adapted to rise with the amount of water inserted into pool (see, FIG. 1*c*), but can be outfitted with external braces or frames for additional support (see, e.g., FIG. 1*d*). Other types of pools can be used with the present cleaning system.

The pool 100 is formed with the base 110 and sidewall 120. The base 110 and sidewall 120 can be manufactured out of many different materials and can be formed of the same materials or each a different material. For example, the base 110 and sidewall 120 of the swimming pool 100 can be formed from a textile (e.g., burlap, etc.) or synthetic material (e.g., plastics, polyurethane, PVC, nylon, etc). Many materials (especially water-permeable textiles, etc.) can be used to construct a pool; the materials, however, should be treated to retain water. For example, such materials could be adhered to, laminated with, coated with, or bonded to a material impermeable to water. In accordance with an exemplary embodiment, the base 110 can be formed from a nylon shell, which can be laminated or otherwise treated to hold water. For example, the nylon shell might be bonded to another material, such as polyurethane, PVC, vinyl, or other suitable impermeable lining to provide the desirable waterproof qualities, and to provide a more pleasing tactile quality to the interior of the pool 100. Similarly, the sidewall 120 of the pool 100 can be constructed from these materials, or other materials having similar suitable qualities. Many of the materials that are used can be selected for their durability.

For example, the base 110 can be formed from materials that can be more durable than the sidewall 120, as this section of the pool 100 can be subjected to more wear than that experienced by the sidewall 120. In addition, as described, the base 110 and sidewall 120 can be formed from a combination of materials, which can be adhered or bonded together. The materials used for the various portions of the pool 100, including, for example, the base 110 and the sidewall 120, can be joined by way of a number of commonly known suitable techniques, such as sewing, adhesives, bonding, lamination, RF welding, other suitable joining techniques, and the like. The connection of the base 110 to the sidewall 120 can be along the bottom 122 of the sidewall 120. The base 110 includes a perimeter, wherein the sidewall 120 can be connected about the perimeter of the base 110.

In one embodiment, the inner wall 126 can be made of pliable plastic, while the outer wall 128 is made of hard plastic. Then, inner wall 126 can limit leakage of fluid should the outer wall 128 crack. Likewise, the material of the inner wall 126 can be made of hard plastic, and the material of the outer wall 128 can be made of pliable material to protect from potential leakage should the hard plastic crack. In another embodiment, the inner wall 126 can be made of hard plastic, while the outer wall 128 can also be made of hard plastic.

Figure 1C:
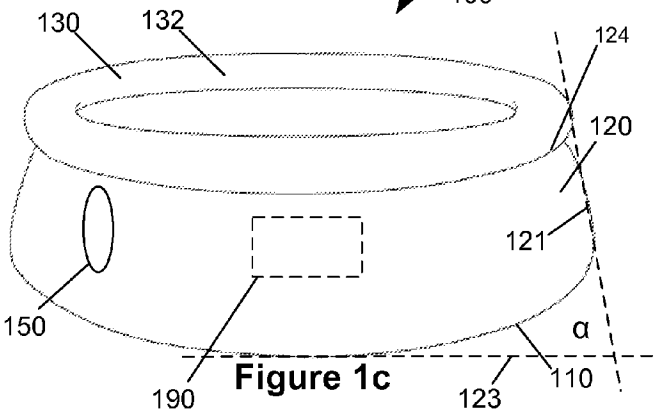
Figure 1c PRIOR ART
FIG. 1*c* is a perspective view of yet another above-ground container, specifically a ring-type swimming pool, in accordance with the prior art.
Figure 1D:
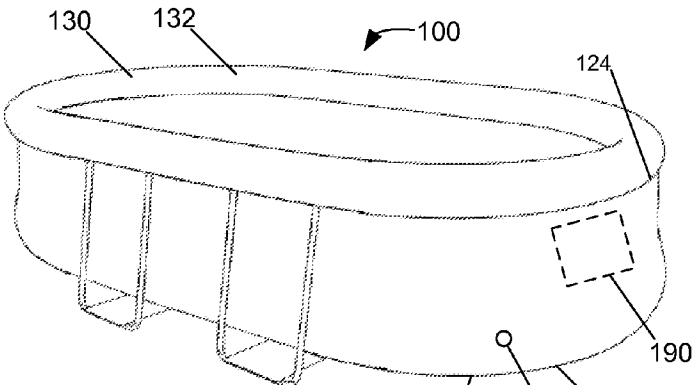
Figure 1d PRIOR ART
FIG. 1*d* is a perspective view of another above-ground container, specifically an oval ring-type swimming pool supported by a frame, in accordance with the prior art.

The pool 100, as illustrated in FIGS. 1*c*-1*d*, can further include a floatation device 130, which is formed in the shape of the pool 100, attached to the top 124 of the sidewall 120. According to an exemplary embodiment shown in FIGS. 1*c*-1*d*, the floatation device 130 can be an inflatable ring 132. This inflatable ring 132, when inflated, can provide some stiffness at the top 124 of the sidewall 120, and can help maintain the overall shape of the pool 100. Moreover, the inflatable ring 132 can provide padding for those entering and exiting the pool 100, and can also provide a manner by which the pool 100 changes from a collapsed to an expanded configuration with the addition of water within the pool 100. Additionally, as the floatation device 130 can be buoyant, it can be made to rise with the level of water within the pool 100, such that as water is deposited in the pool 100 and the floatation device 130 rises with the level of that water, the sidewall 120 is automatically erected as the pool 100 is filled.

As water is deposited in the pool 100, the floatation device 130 and thus the sidewalls 120 can rise with the water level. When the pool 100 is fully inflated, the floatation device 130 can form a semi-rigid or rigid top portion of the pool 100. In some embodiments, when fully inflated, the flexible sidewalls 120 can bulge slightly outward due to the weight of the water in the pool 100. See, FIG. 1*c*. As a result, a straight line drawn from the outer edge of the floatation device 130, tangent to the outermost portion 121 of the sidewall 120, and intersecting the ground 123 can form an acute angle $\alpha$ with the vertical.

The floatation device 130 can be made from a variety of materials. For example, the floatation device 130 can be a standard inflatable polyurethane casing, or similar casing that is suitable for retaining air or other gas in an inflated state. Additionally, the floatation device 130 can make use of a variety of chemical or other reactions that would automatically inflate it. The floatation device 130 can be inflated by conventional means, for example by a valve configured for oral inflation or for inflation by a device such as a pump or an air compressor.

The floatation device 130 can also be made from material that does not require inflation, but provides adequate buoyancy and floats on the water contained within the pool 100 (or other fluid when the pool is used as a general container). For example, special foams, polystyrene, or other materials can be used to create a floatation device 130, which would float with the water line contained in the pool 100, and cause the sidewalls 120 to be erected as the pool 100 fills. In this manner, the pool 100 can automatically change from a collapsed to an expanded configuration. As the pool 100 is a collapsible pool, and adapted to be folded, the floatation device 130 can be made of a material that can be subjected to folding, without becoming damaged. Although some potential materials from which the floatation device 130 can be formed have been mentioned above, other materials including, but not limited to, newly developed materials can be incorporated within the design of the invention, and used to form the floatation device 130 without departing from the invention.

The floatation device 130 can be of a nature other than an inflatable ring. For example, this floatation device 130 can be made of a material that floats, and is bendable, such that it can be folded or bent. The pool 100 can be conveniently collapsed for storage and/or transport by deflating the inflatable ring 132 and folding onto itself along with the base 110 and sidewall 120 materials in a manner that is well known.

Additionally, as illustrated in FIG. 1*c*, the pool 100 can comprise a porthole 150, or a plurality thereof. The portholes 150 are translucent sections of the sidewall 120, integrally formed in/with the sidewall either 120, or separate elements. The portholes 150 are adapted like a window permitting one to see into the pool 100. Similarly, the portholes 150 enable one within the pool to see outside the pool 100. The portholes 150 can further enable determining the level of fluid within the pool 100.

The portholes 150 can be of a particular shape. For instance, the shape of the portholes 150 can be oval. Alternatively, the shape of the portholes 150 can be round or circular. The configuration of the porthole 150, however, can be many shapes. In an exemplary embodiment, the locations of the portholes 150 can be placed symmetrically about the sidewall.

The portholes 150 can aid in safety, as the portholes 150 can enable viewing into the pool 100 through the sidewall 120. If the portholes 150 are removably designed by suitable means, the porthole 150 can also be used as a drainage device, enabling quick emptying of the fluid of the pool 100. The portholes 150 can be integrally formed during manufacturing of the sidewall 120, or removable, wherein they are attached via a waterproof/leak resistant means. The portholes 150 can also be included via a non-removable method, wherein the portholes are secured within the sidewall 120.

The portholes 150 can be secured in different ways within the sidewall 120. In one embodiment, the portholes 150 can be flush with the sidewall 120, such as enabling a drainage device. In another embodiment, the portholes 150 can be insertable between the inner wall 126 and the outer wall 128 of the sidewall 120. In some embodiments, the portholes 150 are sealed between the inner wall 126 and the outer wall 128, wherein there is a hole between the inner wall 126 and the outer wall 128, whereby the porthole seals the hole. The porthole 150, thus, can be sandwiched between the inner wall 126 and the outer wall 128. The porthole 150 can be sealed by conventional compression or heat sealed methods.

The pool 100 can include a ladder (not shown) to enable one to enter and/or exit the pool 100. The ladder can further be insertable into the pool 100, enabling one to exit the pool 100.

Because a rim of the pool 100 is above the ground, the ladder can be flush with the rim for easy entry/exit from the pool 100.

Because the pool 100 is collapsible, the fluid in the pool 100 should be drainable. A drainage assembly 180, as illustrated in FIG. 1*d*, is integral with the pool 100. In an exemplary embodiment, the drainage assembly 180 is a valve, cork, or like device, that is removable or disengagable from the pool 100, such that, when removed/disengaged the water from the pool 100 can be drained. The drainage assembly 180 can also be a valve enabling control of draining the pool 100. The drainage assembly 180 can be many devices enabling easy draining of the pool 100, safely and environmentally.

Above-ground containers provide a number of different collapsible containers, which can be used as swimming pool. The various embodiments described above provide collapsible swimming pool that are collapsible, enable easy storage, and increase portability when compared with prior approaches. Additionally, according to various embodiments, the collapsible swimming pool can be provided with a pop-up mechanism that automatically erects the pool to its full-sized, expanded configuration. The swimming pool can be constructed from durable, lightweight, foldable materials which are not easily damaged, and therefore contribute to their long life.

Pool Canopy System

Figure 2:
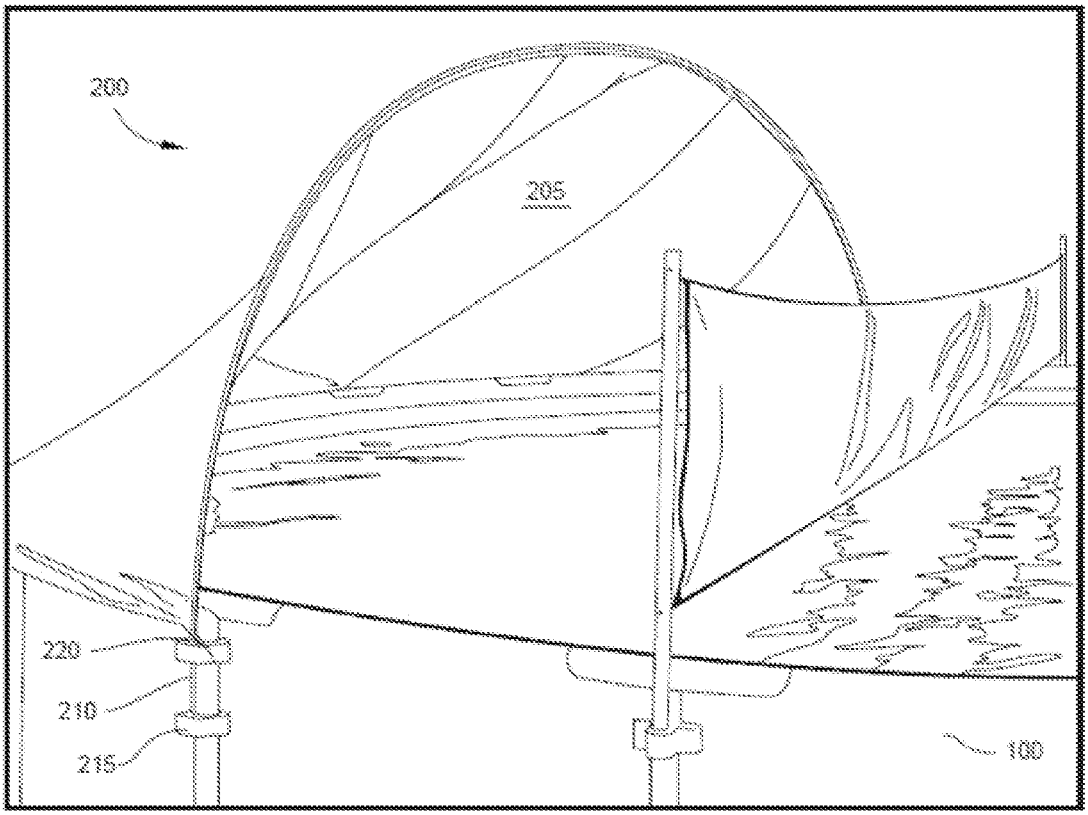
FIG. 2 is a perspective view of the canopy system attached to a pool, in accordance with an exemplary embodiment of the present invention.
Figure 3:
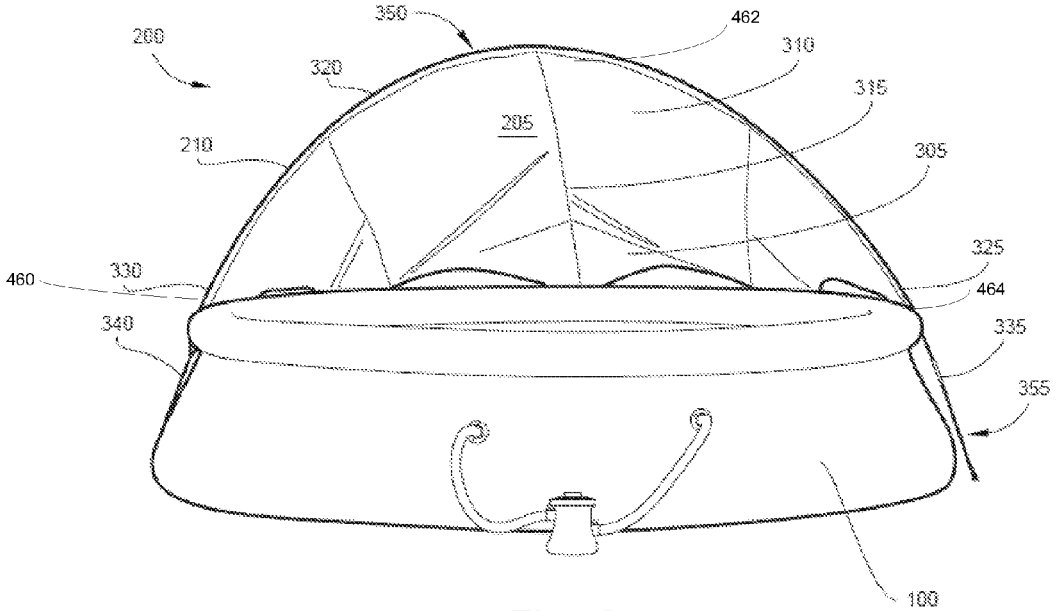
FIG. 3 is another perspective view of the canopy system attached to a pool, in accordance with an exemplary embodiment of the present invention.
Figure 4:
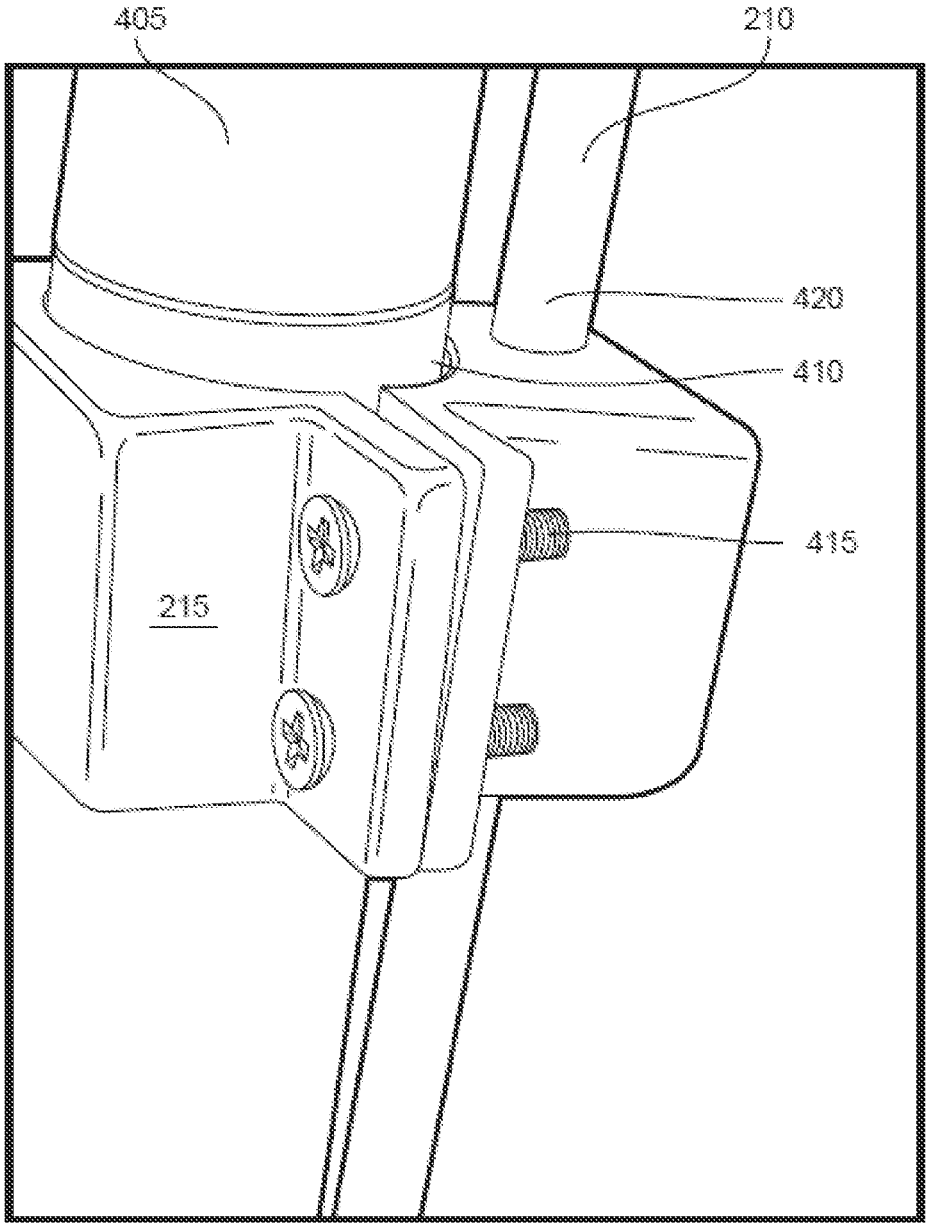
FIG. 4 is a perspective view of an attachment element, in accordance with an exemplary embodiment of the present invention.
Figure 5:
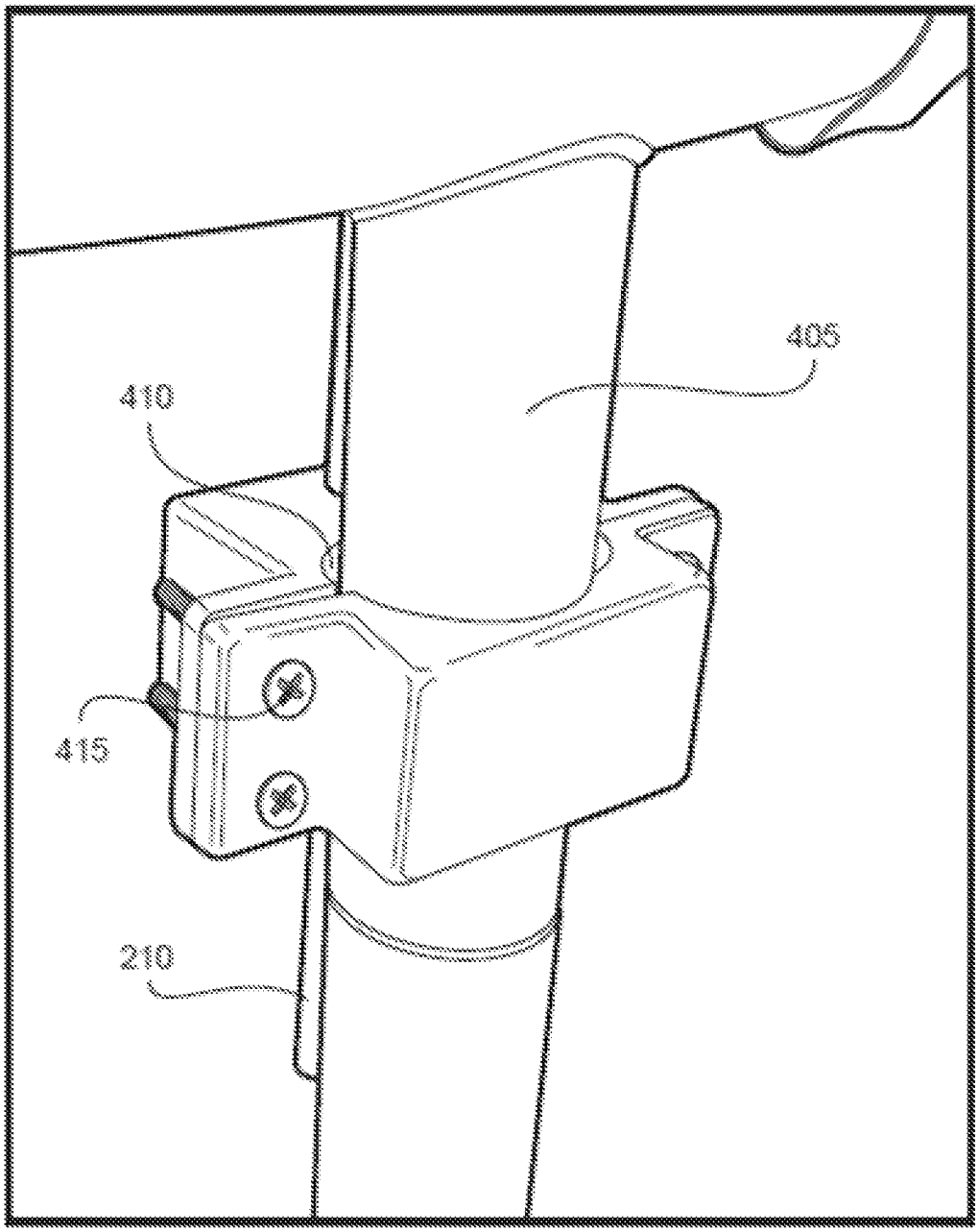
FIG. 5 is another perspective view of the attachment element, in accordance with an exemplary embodiment of the present invention.
Figure 6:
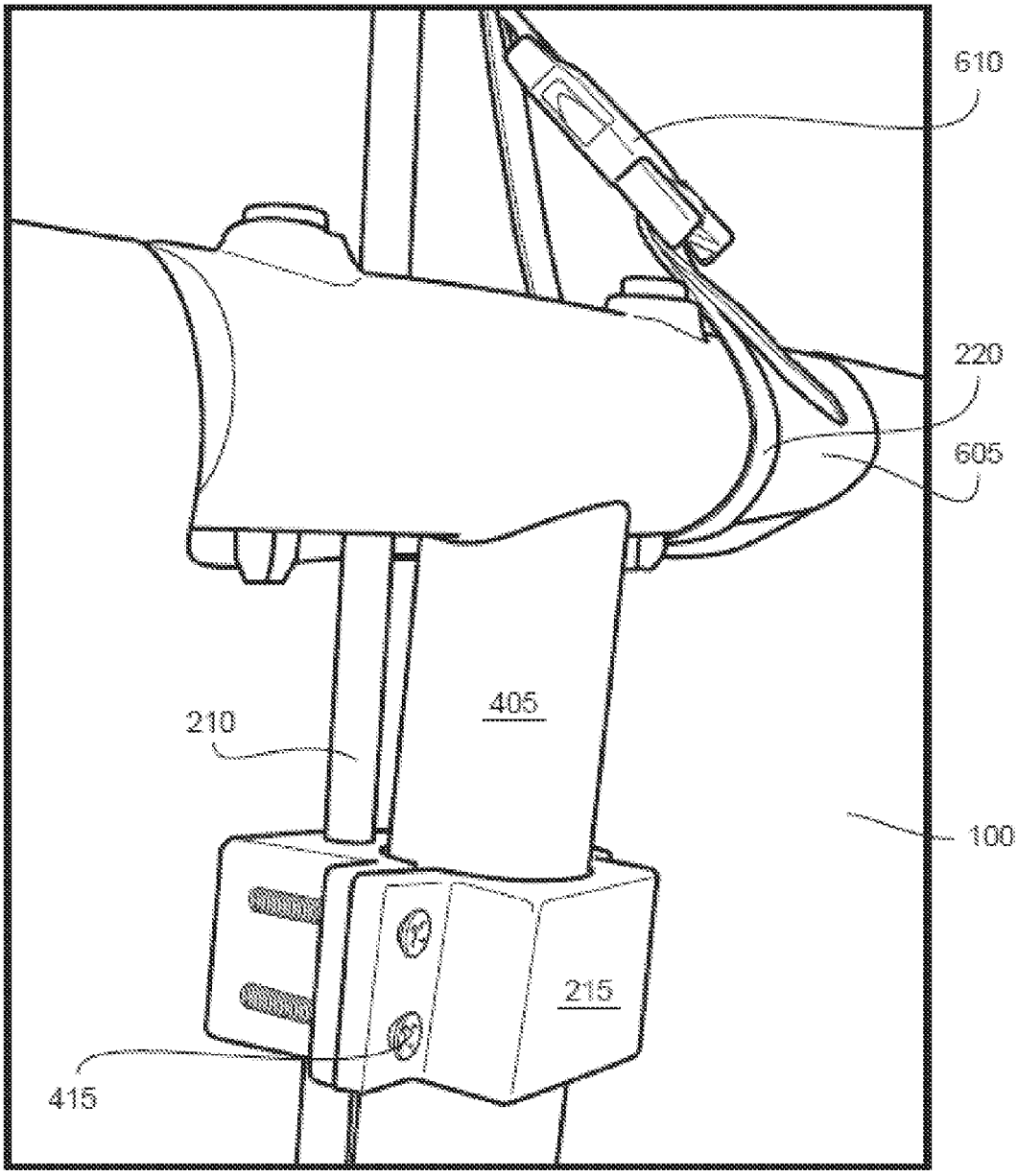
FIG. 6 is a perspective view of a support element and the attachment element, in accordance with an exemplary embodiment of the present invention.

Embodiments of the pool canopy system are illustrated in FIGS. 2-10. Embodiments of the pool canopy system 200 are adapted to provide shade for above-ground swimming pool 100. The pool canopy system 200 comprises a shading element 205, a support element 350 that comprises a support member 210 and shade supports 315, and an attachment element 355 that can comprise a plurality of brackets 215 and a plurality of straps 220. Embodiments of the pool canopy system 200 provide shade over at least a portion of pool 100, as illustrated in FIGS. 2 and 3.

The shading element 205 of the pool canopy system 100 comprises a bottom portion 305 and a top portion 310. The shading element 205 extends up and outward from the bottom portion 305 to the top portion 310. The bottom portion 305 of the shading element 205 is adjacent the pool 100 and the top portion 310 of the shading element 205 can hover over the pool 100 in an arc-like fashion to shade at least a portion of the pool 100. In various embodiments, the shading element 205 shades approximately one-third to one-half of the pool 100. The amount of shade depends on the relationship between the light source (e.g., the sun) and the shading element 205. The shading element 205 can be substantially semi-circular in shape when laid flat. The shading element 205 can be made up of various shading materials, for example but not limited to, plastic, cloth, and combinations thereof. Additionally, the shading element 205 can be made up of one large piece of shading material or a plurality of shading materials that are attached together by an attaching means, such as thread stitching, glue, staples, or combinations thereof.

The pool canopy system 200 further comprises a support element 350 which comprises a support member 210 and a plurality of shade supports 315. The support member 210 is adapted to provide structure and durability to the shading element 205. The support member 210 can be semi-circular in configuration and extends along a front edge 320 of the shading element 205 from a first end 325 to a second end 330 of the shading element 205. The support member 210 also comprises a first end 335 and a second end 340. In an exemplary embodiment, if the pool canopy system 200 is used to shade a ring pool, the first end 335 and second end 340 of the support member 210 can extend to the ground and can pierce the ground to a depth that provides adequate structural support for the shading element 205. In another exemplary embodiment, if the pool canopy system 200 is used to shade a frame pool, the first 335 and second 340 ends of the support member 210 can be mounted to a frame pool 100 using brackets 215. The support member 210 can be, for example but not limited to, a flexible pole, rod, or bar. Additionally, the support member 210 can be configured to bend and/or fold, which enables the portability of the pool canopy system 200.

The shade supports 315 also maintain the arc-like configuration of the shading element 205 and provide additional durability to the shading element 205. The shade supports 315 are attached to the shading element 205 and extend upward from the bottom portion 305 to the top portion 310 of the shading element 205. Some embodiments of the pool canopy system 200 comprise at least three shade supports 315, which are proportionately placed along the shading element 205, as illustrated in FIG. 3. Other embodiments, however, can comprise more or less shade supports 315. In some embodiments, support member 210 extends from first end 460 of shading element 205 along at least a portion of front edge 462 of shading element 205 to second end 464 of shading element 205.

The attachment element 355 of the pool canopy system 200 can comprise a plurality of brackets 215 and/or a plurality of straps 220. The brackets 215 are adapted to receive a vertical support 405 of a frame pool 100 and secure the support member 210 to the vertical support 405, as illustrated in FIGS. 4-7. More specifically, the bracket 215 defines an opening 410 adapted to receive the vertical support 405 of the frame pool 100. The bracket 215 can receive vertical supports 405 of many diameters and shapes, e.g., circular, oval, and "D" shaped vertical supports 405. The bracket 215 further comprises a securing means 415 that allows the bracket 215 to secure and tighten around the vertical support 405 of the frame pool 100. The securing means 415 can be, for example but not limited to, a single or a plurality of screws, bolts, anchors, or combinations thereof.

Figure 8:
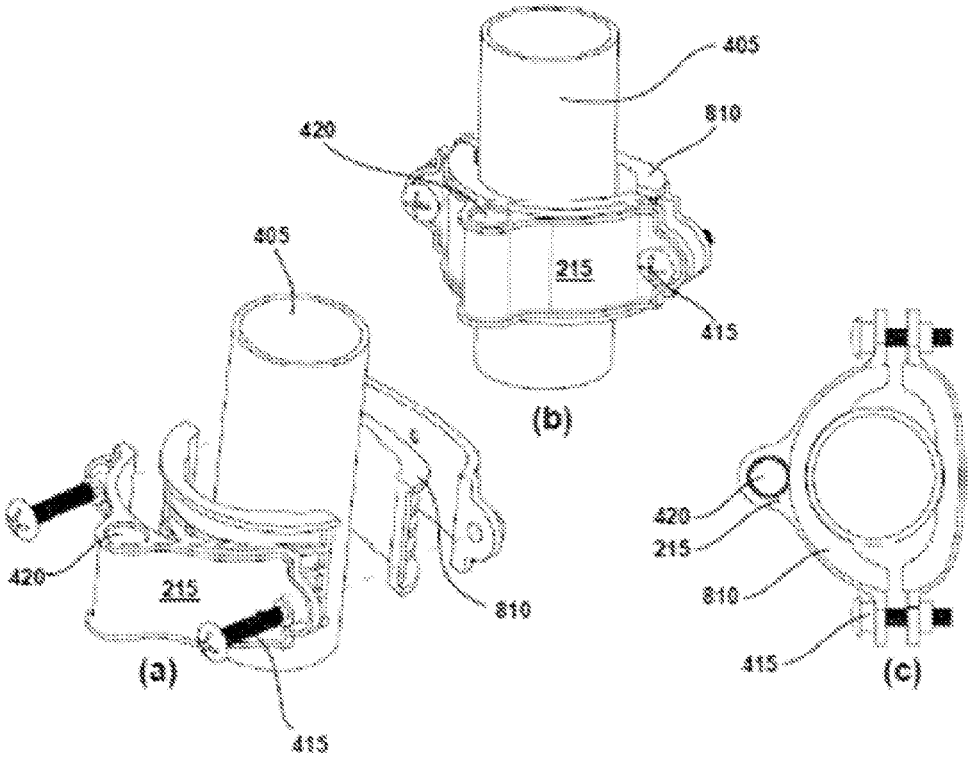
FIG. 8 is a perspective view of a bracket and a circular shaped insert element, in accordance with an exemplary embodiment of the present invention.
Figure 9:
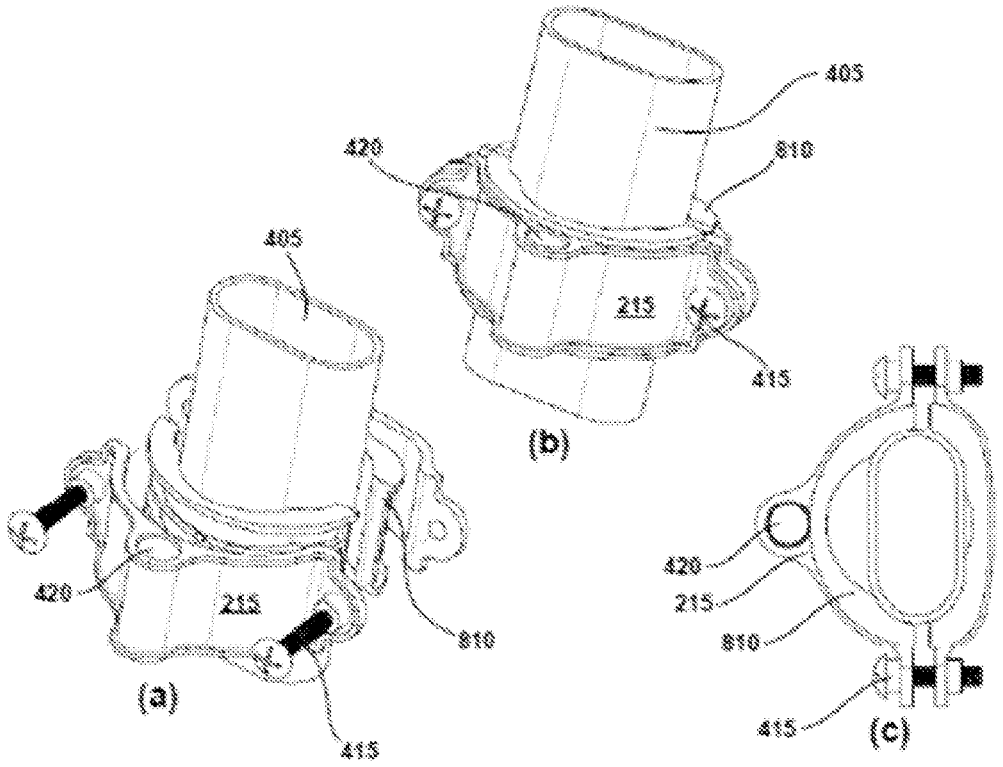
FIG. 9 is another perspective view of a bracket and an oval shaped insert element, in accordance with an exemplary embodiment of the present invention.
Figure 10:
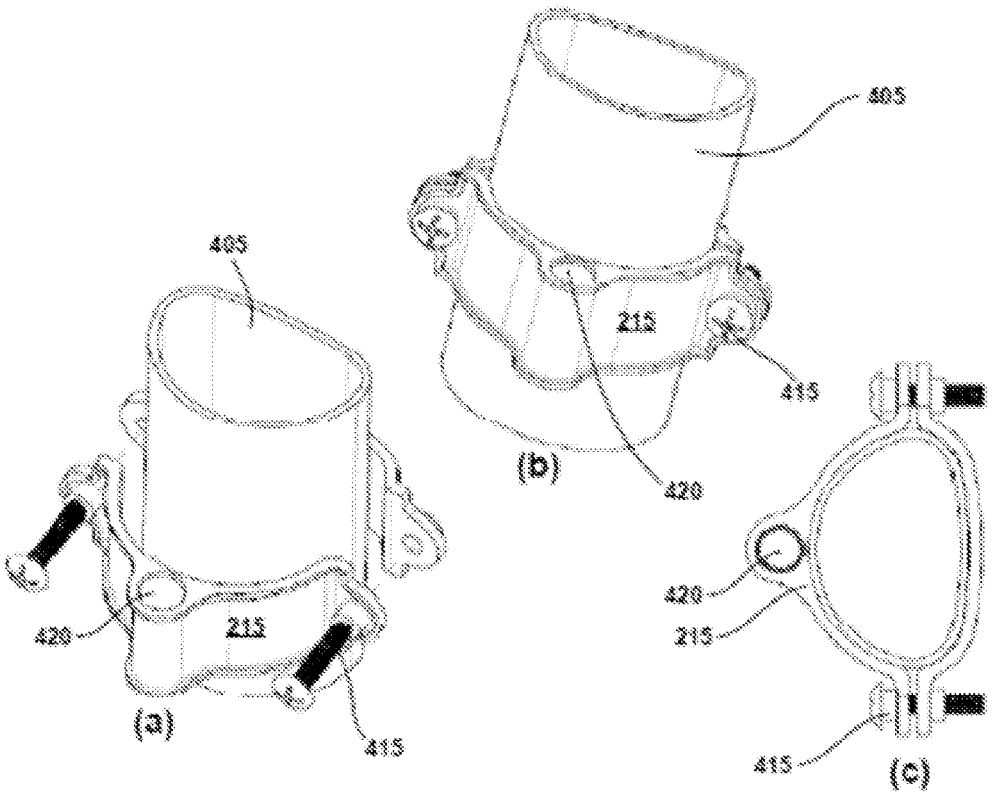
FIG. 10 is a perspective view of a bracket, in accordance with an exemplary embodiment of the present invention.
Figure 11:
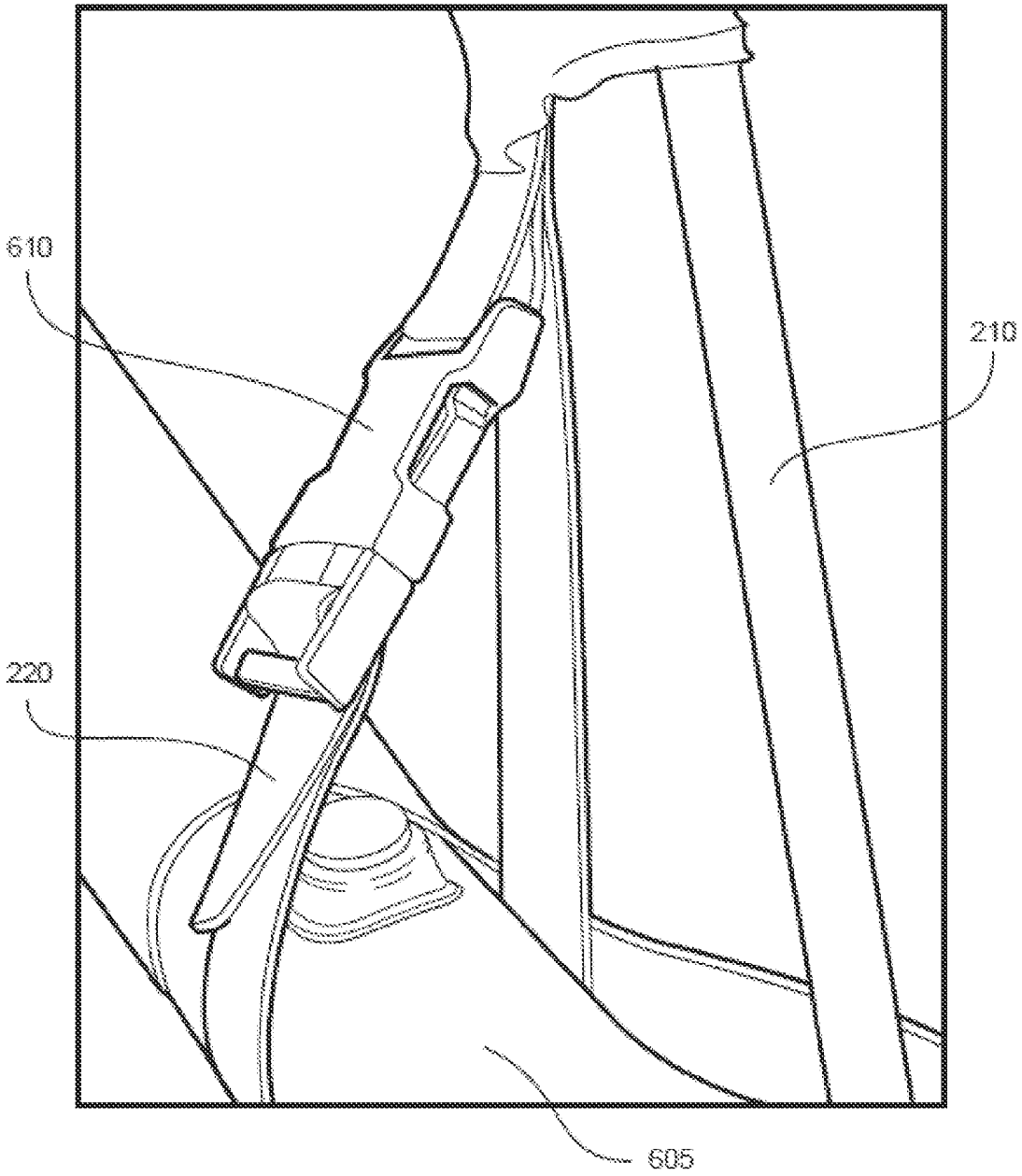
FIG. 11 is yet another perspective view of the support element and the attachment element, in accordance with an exemplary embodiment of the present invention.
Figure 12:
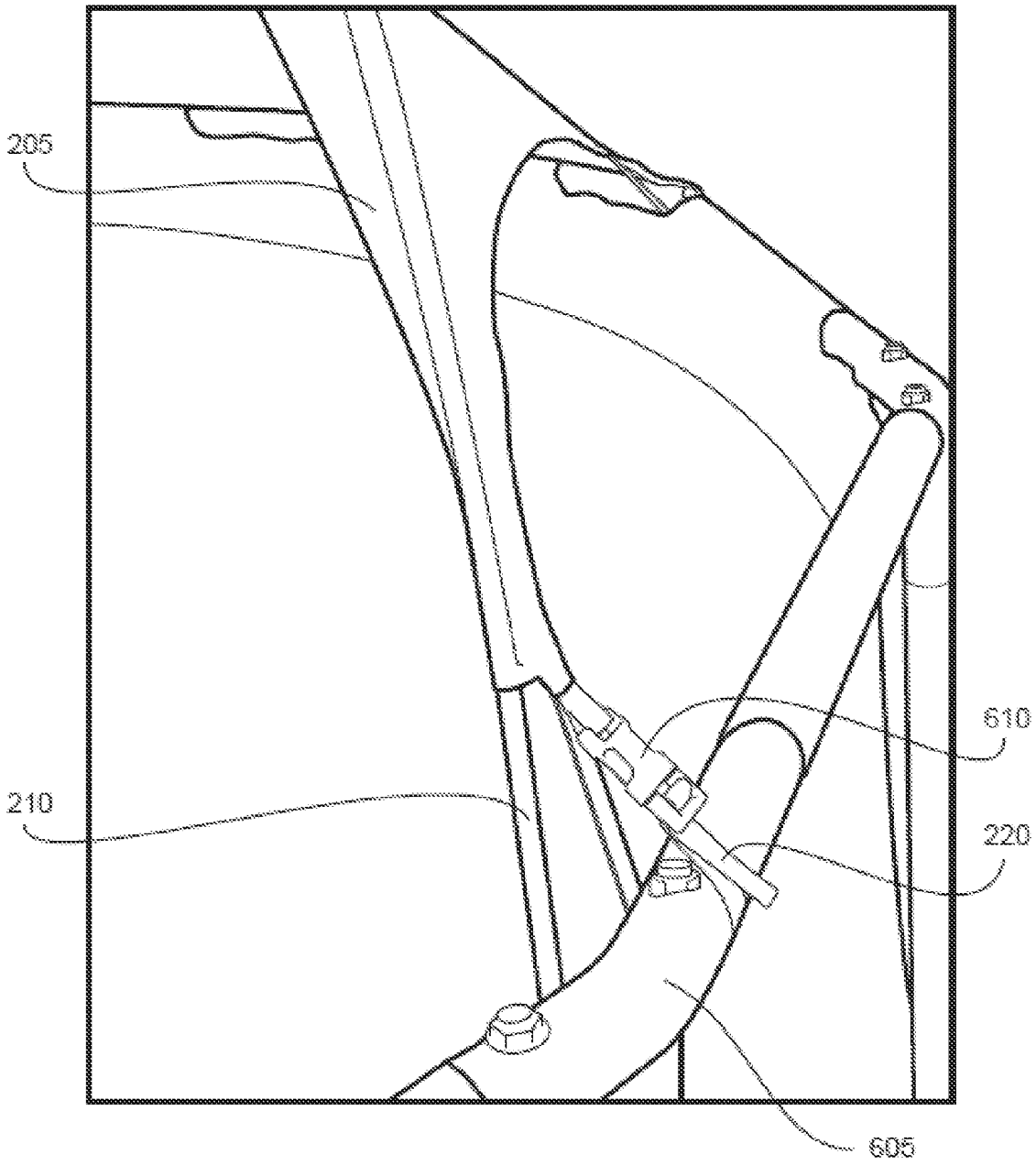
FIG. 12 is another perspective view of a shading element, the support element, and the attachment element, in accordance with an exemplary embodiment of the present invention.
Figure 13:
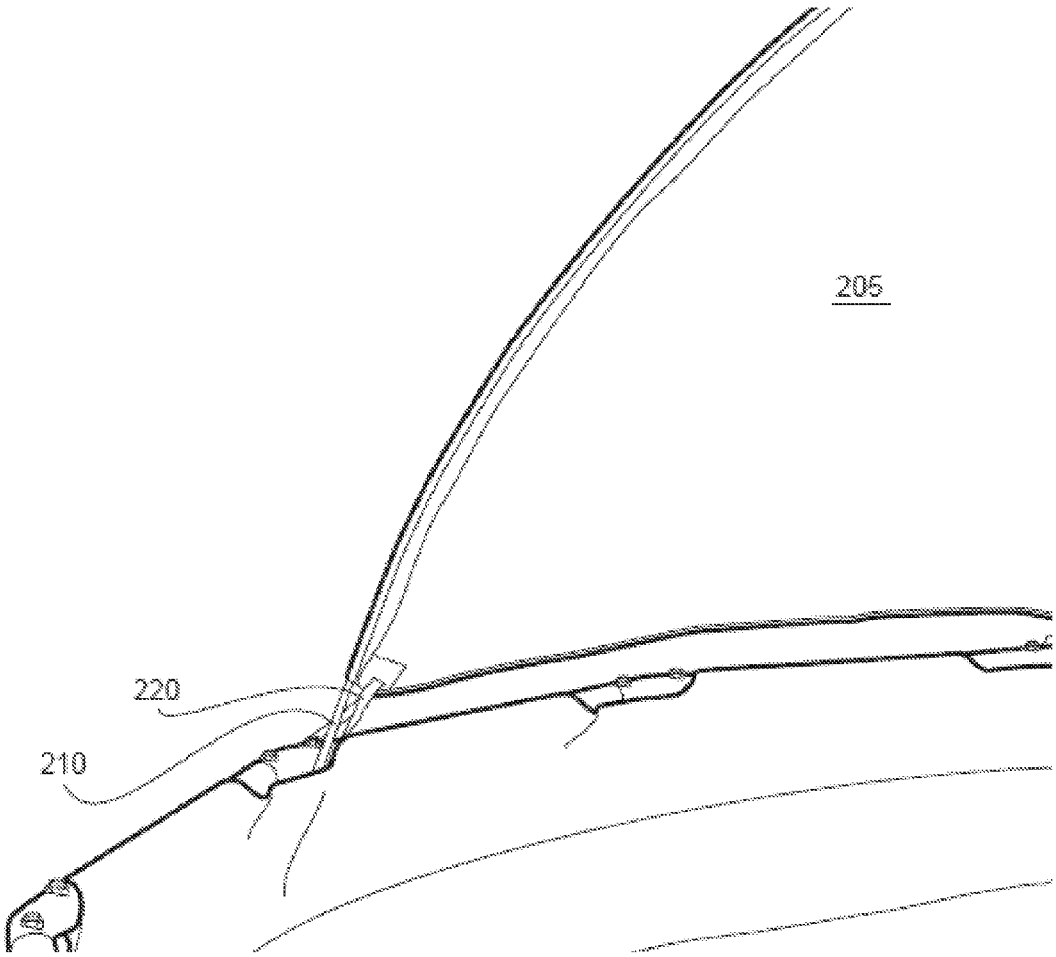
FIG. 13 is another perspective view of the shading element, the support element, and the attachment element, in accordance with an exemplary embodiment of the present invention.

For circular and oval shaped vertical supports 405, an insert element 810 can be installed within the bracket 215 to further secure the circular and oval shaped vertical supports 405, as illustrated in FIGS. 8 and 9. The insert can be configured to comprise an inner cutout profile that accommodates circular and oval shaped vertical supports 405. This configuration enables the insert element 810 to fit within the bracket 415 and further secure and tighten around circular and oval shaped vertical supports 405, respectively. The insert element 810 can be made of, for example but not limited to, plastic or aluminum alloy. In another example, and as illustrated in FIG. 10, an insert 810 may not be necessary for "D" shaped vertical supports 405 as the inner cutout profile of the bracket 415 is already configured to accommodate "D" shaped vertical supports.

The bracket can also define an aperture 420 adapted to receive a portion of the support member 210. The aperture 420 is of substantially the same cross-section as the support member 210, such that the support member 210 can slide within the aperture 420 and securely fit within the aperture 420. This configuration keeps the pool canopy system 200 secure and in place during slightly windy and other mild weather conditions. Embodiments of the present invention can comprise at least two brackets 215, one for each end of the support member 210; other embodiments, however, can comprise more brackets 215.

The attachment element of the pool canopy system 200 can further comprise a plurality of straps 220 to assist in securing the remaining portions of the shading element 205. For example, in the case of frame pools, the plurality of straps 220 are attached and proportionately arranged along the bottom portion 305 of the shading element 205. The straps 220 are also attached along the bottom portion 305 of the front edge 335 of the shading element 205 adjacent the support member 210. The plurality of straps 220 are adapted to wrap around horizontal supports 605 of pool 100. The straps 220 can be of an adjustable nature so that they can wrap and tighten around horizontal supports 605 of various dimensions. The straps can further comprise a fastening means 610, which enables the shading element 205 to be mounted and dismounted from the horizontal support 605 of the pool 100. The fastening means 610 can be, for example but not limited to, a clasp or clip fastening means, a hook and loop fastening means, a zipping means, or combinations thereof. FIGS. 6-7 and 11-13 provide perspective views of the straps 220 wrapped around horizontal supports 605 of frame pools 100. As another example, in the case of ring pools, the straps 220 are configured in the same way as described above, however, the straps 220 wrap around stakes secured in the ground.

Figure 14:
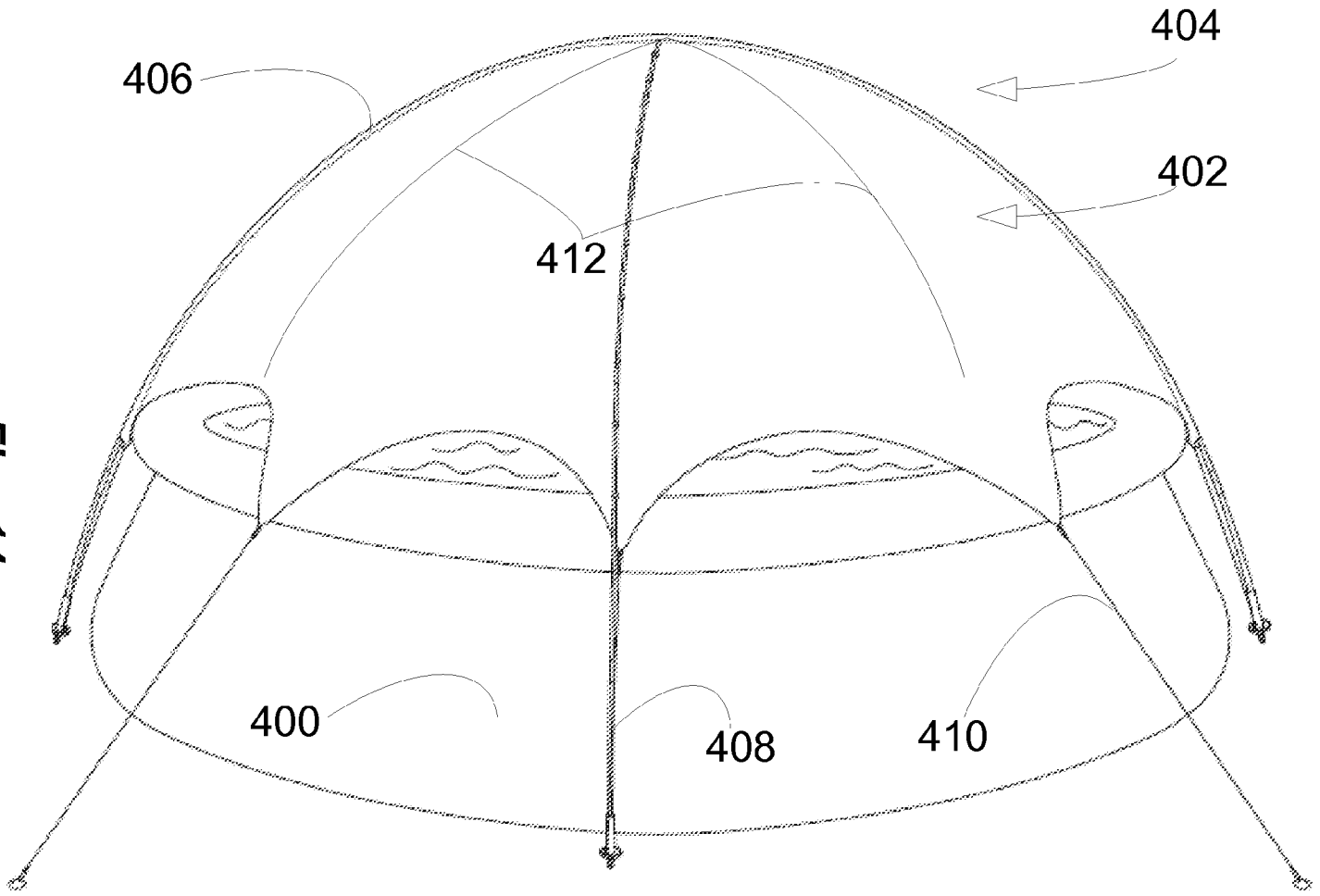
FIG. 14 is a further perspective view of the shading element, the support element, and the attachment element, in accordance with an exemplary embodiment of the present invention.

FIG. 14 illustrates in further detail the securement of a canopy for use in conjunction with ring pool 400 in according with various embodiments of the present invention. To provide for shade from the sun or other environmental elements such as wind or rain, pool 400 is used in conjunction with shading element 402. Shading element 402 comprises support element 404 which helps to support shading element 402 as well as provides a degree of structural rigidity to shading element 402. Support element 404 can comprise support member 406 and shade support 408. To provide for additional structural rigidity, shading element 402 can additionally comprise at least one secondary shading element support 412.

Figure 7:
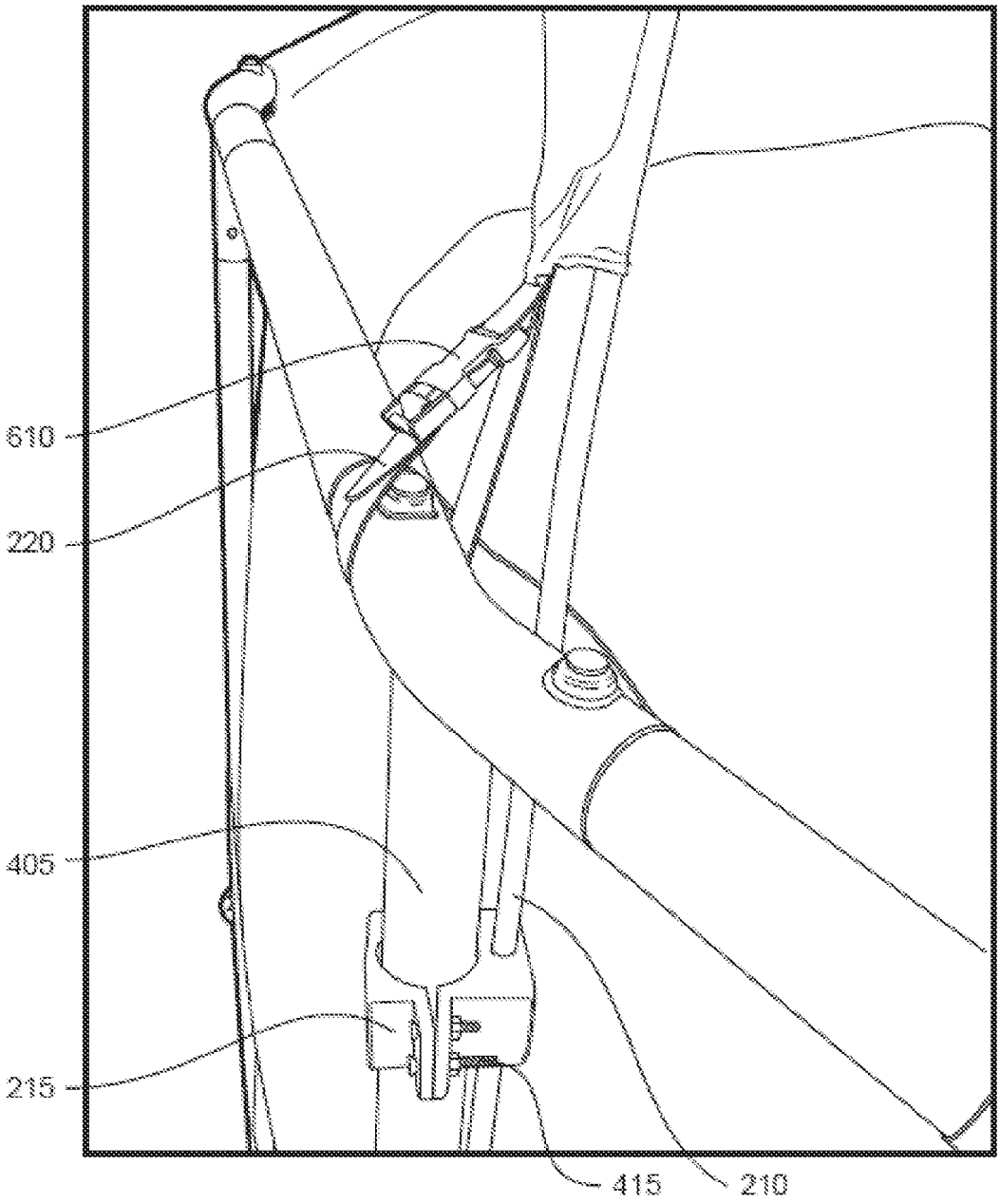
FIG. 7 is another perspective view of the support element and the attachment element, in accordance with an exemplary embodiment of the present invention.

As discussed above, when using a pool having a frame, such as the embodiment of FIG. 7, a shading element can be affixed to the frame of the pool. But, in a ring pool where no such frame is provided, it may be necessary to affix shading element 402 to another solid support, such as the ground, to secure the shading element 402. In one embodiment of the present invention, shading element 402 is configured to secure to the ground via the use of support element 404. In various embodiments, support element 404 can have at least one support member 406, at least one shade support 408, and strap 410. Support member 406, shade support 408, and/or strap 410 can be secured to the ground using various securement mechanisms. For example, one or both ends of support member 406, one end of shade support 408, and/or strap 410 can be inserted into the ground.

Figure 15:
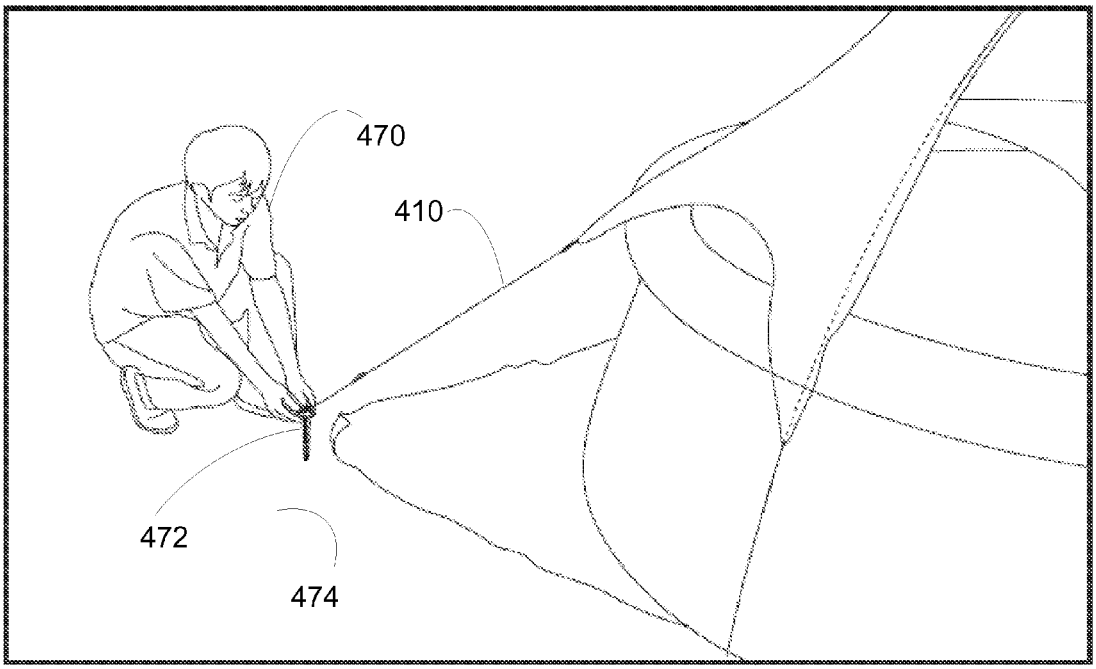
FIG. 15 is side perspective view illustrating the securement of the shading element to the ground.

In other embodiments, one or both ends of support member 406, one end of shade support 408, and/or strap 410 can be secured to the ground using a support member securement device such as a ground stake. In one embodiment, to secure strap 410 to the ground, strap 410 can be attached to a ground stake (not shown) that inserted into the ground. FIG. 15 illustrates the use of a support member securement device. User 470 inserts support member securement device ground stake 472 into ground 474. Ground stake 472 is affixed, either permanently or temporarily, to strap 410.

From the foregoing, it can be seen that the invention provides embodiments of a pool canopy system that provides shade to at least a portion of either an above-ground frame container. The various embodiments of the invention described above provide a pool canopy system that can be used for above-ground pools of various sizes and shapes. The pool canopy system of the present invention is securely positioned above the desired pool and maintains its shape and structure during slightly windy and other mild weather conditions.

The specific configurations, choice of materials, and the size and shape of various elements can be varied according to particular design specifications or constraints requiring a container constructed according to the principles of the invention. Such changes are intended to be embraced within the scope of the invention.

The presently disclosed embodiments are, therefore, considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A canopy system for shading at least a portion of an above-ground container, the canopy system comprising:
- a shading element comprising:
  - a bottom portion;
  - a top portion; and
  - wherein the shading element extends in a generally upward and outward direction from the bottom portion to the top portion; and
- a support element comprising:
  - at least one support member; and
  - at least one shade support;
- a plurality of brackets each comprising: at least one fastener and an aperture;
- the plurality of brackets being configured to attach to a vertical support of the above-ground container, and wherein the support member passes through the aperture and is secured at an additional location.

2. The system of claim 1, wherein the at least one support member extends from a first end of the shading element, along at least a portion of a front edge of the shading element, to a second end of the shading element.

3. The system of claim 1 further comprising an insert element disposed between the at least one bracket and the vertical support of the frame of the above-ground container, wherein the insert element further secures the at least one bracket to the vertical support of the frame of the above-ground container.

4. The system of claim 1, wherein the at least one support member is selected from the group consisting of a flexible pole, a rod, and a bar.

5. The system of claim 1 further comprising a plurality of semi-rigid or rigid shade supports that extend in a generally vertical direction from approximately the bottom portion of the shading element to approximately the top portion of the shading element.

6. The system of claim 1 further comprising at least one secondary shading element support that extends from approximately the top portion of the shading element to approximately the bottom portion of the shading element.

7. The system of claim 6 further comprising a plurality of straps that attach the secondary shading element support to the above-ground container.

8. The system of claim 1 further comprising a plurality of straps that attach the bottom portion of the shading element to a first portion of a frame of the above-ground container and attach at least a portion of a front edge of the shading element to a second portion of the frame of the above-ground container.

9. A canopy system for shading at least a portion of an above-ground pool, the canopy system comprising:
- a shading element comprising:
  - a bottom portion adjacent to a sidewall of the above-ground pool; and
  - a top portion situated above the above-ground pool;

a shade support element comprising:

at least one support member extending at least from a first portion of the above-ground pool to a second portion of the above-ground pool opposite the first portion; and at least one shade support member configured to provide support to the shading element at least from a third portion of the above-ground pool to a position located above the above-ground pool;

at least two brackets configured to each receive a portion of a support frame of the above-ground pool and the at least one support member, comprising:

at least one of fastener; and an aperture;

wherein the portion of a support frame of the above-ground pool passes through the aperture and is secured at an additional location.

10. The system of claim 9 further comprising a plurality of straps that attach the bottom portion of the shading element to a first portion of the support frame of the above-ground container.

11. The system of claim 9 further comprising an insert element disposed between each of the at least two brackets and a portion of a support frame of the above-ground pool.

12. An above-ground container comprising:

a container frame comprising:

a plurality of horizontal container support members; and a plurality of vertical container support members;

a base;

a sidewall supported by the container frame;

a shading element comprising:

a bottom portion adjacent to the sidewall; and a top portion situated above the base;

a shade support element comprising:

at least one support member extending at least from a first vertical container support member of the plurality of vertical container support members to a second vertical container support member of the plurality of vertical container support members on an opposite side of the container; and at least one shade support member configured to provide support to the shading element at least from one horizontal container support member of the plurality of horizontal container support members to a location above the base;

a first bracket configured to receive the first vertical container support member and the at least one support member, comprising:

at least one fastener; and an aperture having an inner diameter substantially equal to an outer diameter of the at least one support member; and a second bracket configured to receive the second vertical container support member and the at least one support member, comprising:

at least one fastener; and an aperture;

wherein the at least one support member passes through the apertures of the first and second brackets and is secured at an additional location.

13. The system of claim 12 further comprising a plurality of straps that attach the bottom portion of the shading element to the container frame.

14. The system of claim 12 further comprising an insert element disposed between the first bracket and the first vertical container support member, wherein the insert element further secures the first bracket to the first vertical container support member.

* * * * *